United States Patent [19]

Barbee

[11] 4,043,753

[45] Aug. 23, 1977

[54] GRAFTING PROCESS FOR PREPARING A POLYESTER FABRIC HAVING DESIRABLE STAIN-RELEASE, ANTISOIL-REDEPOSITION, ANTISTATIC AND HYDROPHILIC PROPERTIES

[75] Inventor: Robert B. Barbee, Kingsport, Tenn.

[73] Assignee: Eastman Kodak Company, Rochester, N.Y.

[21] Appl. No.: 662,673

[22] Filed: Mar. 1, 1976

Related U.S. Application Data

[63] Continuation of Ser. No. 418,162, Nov. 21, 1973, now Defensive Publication No. T939,008.

[51] Int. Cl.[2] ..... D06G 1/02; C08G 63/12

[52] U.S. Cl. ..... 8/115.5; 8/DIG. 4; 8/DIG. 18; 260/75 UA; 260/872

[58] Field of Search ..... 8/115.5, DIG. 4, DIG. 18; 260/872, 75 UA

[56] References Cited

U.S. PATENT DOCUMENTS

| | | | |
|---|---|---|---|
| 2,657,194 | 10/1953 | Butler et al. | 260/75 U |
| 2,657,195 | 10/1953 | Toland | 260/75 U |
| 3,030,208 | 4/1962 | Schellenberg | 96/35 |
| 3,066,117 | 11/1962 | Thomas et al. | 260/77.5 |
| 3,188,228 | 6/1965 | Mayat et al. | 117/62 |

*Primary Examiner*—Richard B. Turer

*Attorney, Agent, or Firm*—Charles R. Martin; Daniel B. Reece, III

[57] ABSTRACT

Disclosed is a process for preparing fabrics which exhibit desirable stain-release, antisoil-redeposition, antistatic and hydrophilic properties. According to this process, a fabric comprised of a fiber of poly(ethylene terephthalate) modified with p-carboxycinnamic acid is contacted with acrylic acid and a free radical initiator under grafting reaction conditions.

2 Claims, No Drawings

GRAFTING PROCESS FOR PREPARING A POLYESTER FABRIC HAVING DESIRABLE STAIN-RELEASE, ANTISOIL-REDEPOSITION, ANTISTATIC AND HYDROPHILIC PROPERTIES

This is a continuation of Application Ser. No. 418,162 filed Nov. 21, 1973, now Defensive Pub. No. T939,008, Sept. 7, 1975.

This invention relates to the preparation of fabrics of polyester fibers which exhibit desirable stain-release, antisoil-redeposition, antistatic and hydrophilic properties.

In recent years, the textile industry has sought to prepare fabrics of synthetic fibers which exhibit desirable stain-release, antisoll-redeposition, antistatic and hydrophilic properties. Although many stain-release and antistatic finishes perform well, these finishes are typically not durable to launderings.

I have now invented a process for preparing a fabric of polyester fibers which exhibits desirable stain-release, antisoil-redeposition, antistatic and hydrophilic properties.

Broadly, this process of this invention can be described as a process comprising A. preparing a textile fabric of fibers formed from a polyester of
   1. terephthalic acid,
   2. ethylene glycol, and
   3. based on the moles of terephthalic acid, from 1 to 10 mole percent p-carboxycinnamic acid, and B. contacting the textile fabric, under grafting reaction conditions, with acrylic acid and a free radical initiator.

The textile fabrics useful in this invention are well known in the art and can be prepared using conventional methods. The textile fabrics of this invention can comprise flat goods which have been prepared by weaving or knitting yarns which have been prepared from either staple or continuous filament fibers. In this invention, the textile fabric can also comprise a carpet. The polyester fibers used in this invention can be prepared from the polyester polymer using conventional processes.

The polyester polymer can be prepared by conventional methods of preparing a high molecular weight polyester. In one embodiment dimethyl terephthalate, p-carboxycinnamic acid and ethylene glycol is ester interchanged in the presence of a suitable conventional ester interchange catalyst, such as a mixture of zinc and antimony, and then polycondensation is conducted in the presence of a conventional polycondensation catalyst, such as titanium isopropoxide. Lower alkyl esters of p-carboxymethoxy cinnamate can be used. Other catalysts such as tin can be used.

It is believed that the polyester of this invention has a structure corresponding to the formula:

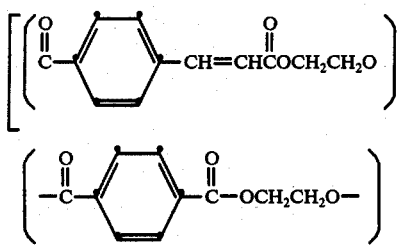

-continued

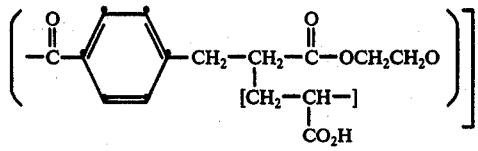

The amount of p-carboxycinnamic acid in the polyester can be from 1 to 10 mole percent, based on the moles of terephthalic acid.

The grafting reaction conditions that can be used in this invention can vary widely. Although other times can be used, in one embodiment the time can be from 5 minutes to 30 minutes. Although a wide range of temperatures can be used, in one embodiment the temperature can be approximately ambient temperature. The one embodiment the fabric can be contacted with the free radical initiator and and then subsequently contacted with the acrylic acid. The acrylic acid can be either in the liquid or vapor phase when contacted with the textile fabric. Although it is not necessary, in many instances the acrylic acid can be contacted with the textile fabric in the presence of a contacting agent which can be either in the liquid or vapor phase. Although other contacting agents can be used, in one embodiment perchloroethylene is entirely satisfactory for use.

The free radical initiator useful in this invention is well known in the art. Although a wide variety of known free radical initiators can be used, lauroyl peroxide is a particularly desirable free radical initiator.

The polyesters of this invention have an inherent viscosity of at least 0.4, and preferably at least 0.5, measured at 25° C. using 0.23 grams of polymer per 100 ml. of a solvent composed of 60 volumes of phenol and 40 volumes of tetrachloroethane.

EXAMPLE 1

This example illustrates the preparation of p-carboxycinnamic acid.

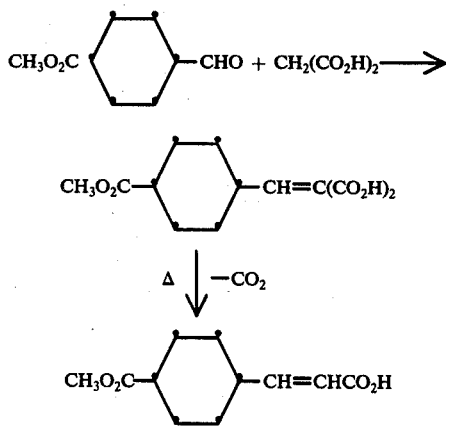

A mixture of 690 g. (6.6 moles) of malonic acid, 603 g. (3.68 moles) of methyl p-formyl benzoate, 7 ml. of piperidine and 890 ml. pyridine is stirred under a nitrogen atmosphere. The temperature is kept at 50°-60° C. during a period of 2 hours, and then at 70°-75° C. for 6 hours. The mixture is cooled and poured into a cold solution of 855 ml. of concentrated hydrochloric acid in 6700 ml. of water. The resulting while solid is removed by filtration, washed with water, and dried to give 735 g. (97%) of p-carbomethoxy cinnamic acid, melting point 241°-244° C.

EXAMPLE 2

This example illustrates the preparation of methyl p-carboxycinnamate.

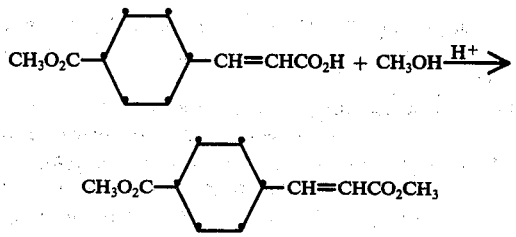

A mixture of 40 g. of p-carbomethoxy cinnamic acid and 600 ml. of methanol is heated for 2 hours at 225° C. in a stirred autoclave. The reaction mixture was filtered, and the resulting white solid was washed with methanol, sodium bicarbonate solution, and water and dried to give 27 g. (64%) of methyl p-carbomethoxy cinnamate, melting point 122°-124° C. Recrystallization from methanol gave material melting at 123°-125° C.

Anal. Calcd. for $C_{12}H_{12}O_4$: C, 65.45; H, 5.49. Found: C, 65.59; H, 5.60.

EXAMPLE 3

This example illustrates the preparation of textile fibers from a polyester prepared from P-carboxycinnamic acid.

Dimethyl terephthalate (77.6 g.; 0.4 mole), 20.6 g. (0.1 mole) of p-carbomethoxy cinnamic acid, 62.0 g. (1.0 mole) of ethylene glycol, 1.0 g. of an ethylene glycol solution containing soluble zinc acetate to give 65 ppm. Zn in the finished copolymer, 2.4 g. of an ethylene glycol solution containing soluble antimony acetate to give 230 ppm. Sb, and 0.1 ml. of titanium isopropoxide in butanol solution to give 15 ppm. Ti are placed in a reaction flask. The reaction mixture is heated under nitrogen atmosphere at 200°-210° C. for 2 hours. The theoretical volume of methanol is collected. The reaction temperature is then rapidly increased to 280° C. The pressure is reduced to 0.2 mm. for a period of 1 hour. The reaction mixture is a viscous, clear melt. The copolymer is cooled to 25° C. and the pressure released to a nitrogen atmosphere. The resulting polymer has a melting point of 200°-205° C. (by Fischer-John Hot Stage Melting Point apparatus) and an inherent viscosity of 0.74. Fibers can be drawn from the melt. These fibers are strong and can be drafted and further processed into textile fibers.

EXAMPLE 4

This example illustrates the preparation of textile fibers from a polyester prepared from p-carboxycinnamic acid.

The general conditions and quantities of Example 3 are followed except 90 g. (1.0 mole) of 1,4-butanediol is used as the dihydric alcohol, and 1.0 ml. of titanium isopropoxide in a butanol solution to give 150 ppm. titanium catalyst. The polycondensation step is carried out at 245° C./0.2 mm for 1 hour. The resulting white copolymer has a $T_g$ of 42° C. and an inherent viscosity of 1.07. Textile fibers are prepared from the polyester.

EXAMPLE 5

This example also illustrates the preparation of textile fibers from a polyester prepared from p-carboxycinnamic acid.

A mixture of 93 g. (0.48 mole) of dimethyl terephthalate, 4.4 g. (0.04 mole) of methyl-p-carbomethoxy cinnamate, 62 g. (1.0 mole) of ethylene glycol, 1.0 g. solution of an ethylene glycol containing soluble $Sn(OAc)_2$ to give 65 ppm. Sn, and 2.8 g. of an ethylene glycol solution containing soluble $Sb(OAc)_3$ to give 230 ppm. Sb is treated in the esterification step similarly to Example 3. The polycondensation step is carried out at 263° C./0.2 mm. for 1 hour. A clear, viscous copolymer with an inherent viscosity of 0.55 results. Textile fibers are prepared from the polyester.

EXAMPLE 6

This example illustrates the process of the invention.

A fabric comprised of fibers prepared from a poly(ethylene terephthalate) modified with 4 mole percent p-carboxycinnamic acid is prepared. 1.0 g. of the fabric is heated for 15 minutes in 10 ml. of refluxing perchloroethylene containing 0.1 ml. of acrylic acid and 0.01 g. of lauroyl peroxide. The fabric was removed, scoured and dried.

EXAMPLE 7

This example illustrates the process of the invention.

1.0 g. of the fabric of Example 6 is padded with a solution of 1% lauroyl peroxide in perchloroethylene then suspended in perchloroethylene-acrylic acid vapor for 1 minute, removed, scoured and dried.

EXAMPLE 8

This example illustrates the properties of fabrics subjected to the process of the invention.

The fabric treated as in Example 6 is subjected to 20 cycles of the AATCC IVA wash test, then the AATCC Manhattan stain release test was applied. Stain-release ratings for the fabric are as follows: lipstick-5, liquid makeup-5, salad dressing-5, Wesson oil-5, gear lubricant-5. The highest possible rating is 5 on the scale of 1 to 5.

EXAMPLE 9

This example illustrates the properties of fabrics subjected to the process of the invention.

The fabric treated as in Example 6 is washed 10 times using the AATCC IVA wash test then subjected to a surface resistance test using a low-voltage, two electrode, D.C. technique under conditions of 23°-25° C. and 40% relative humidity. The fabric exhibits a surface resistance value of $3 \times 10^9$ ohm./in.$^2$. A similar fabric not treated in accordance with the process of the invention exhibits a surface resistance value of $6 \times 10^{12}$ ohm./in.$^2$.

The invention has been described in detail with particular reference to preferred embodiments thereof, but it will be understood that variations and modifications can be effected within the spirit and scope of the invention.

I claim:

1. A process comprising

A. preparing a textile fabric of fibers formed from a polyester of 1. terephthalic acid,
2. ethylene glycol, and 3. based on the moles of terephthalic acid, from 1 to 10 mole percent p-carboxycinnamic acid, and B. contacting the textile fabric, under grafting reaction conditions, with acrylic acid and a free radical initiator.

2. The process of Claim 1 wherein the textile fabric is contacting with acrylic acid and lauroyl peroxide in the presence of perchloroethylene.

* * * * *